United States Patent [19]

Boyle

[11] Patent Number: 5,043,057

[45] Date of Patent: Aug. 27, 1991

[54] REMOVAL OF SULFUR FROM RECYCLE GAS STREAMS IN CATALYTIC REFORMING

[75] Inventor: Joseph P. Boyle, Baton Rouge, La.

[73] Assignee: Exxon Research and Engineering Company, Florham Park, N.J.

[21] Appl. No.: 542,499

[22] Filed: Jun. 25, 1990

[51] Int. Cl.[5] ..... C10G 35/06

[52] U.S. Cl. ..... 208/64; 208/65; 208/140; 208/63

[58] Field of Search ..... 208/64, 65, 140

[56] References Cited

U.S. PATENT DOCUMENTS

| | | | |
|---|---|---|---|
| 3,622,520 | 11/1971 | Hayes | 208/140 |
| 3,849,289 | 11/1974 | Voorhies, Jr. | 208/65 |
| 4,191,633 | 3/1980 | Dauber | 208/65 |
| 4,401,558 | 8/1983 | Pellet et al. | 208/65 |
| 4,409,095 | 10/1983 | Peters | 208/65 |
| 4,415,435 | 11/1983 | Lewis | 208/65 |
| 4,425,222 | 1/1984 | Swan | 208/65 |
| 4,613,424 | 9/1986 | Schorfheide | 208/65 |
| 4,741,819 | 5/1988 | Robinson | 208/65 |
| 4,832,821 | 5/1989 | Swann, III | 208/65 |
| 4,925,549 | 5/1990 | Robenson et al. | 208/65 |

*Primary Examiner*—Helane E. Myers
*Attorney, Agent, or Firm*—Henry E. Naylor

[57] ABSTRACT

A catalytic reforming process in which sulfur moieties are removed from a gaseous product stream by use of a sulfur trap comprised of about 10 to about 70 wt. % nickel dispersed on a support. The sulfur which is removed is both sulfur which is inherent in the feed as well as sulfur which results from presulfiding the catalyst.

13 Claims, 2 Drawing Sheets

REMOVAL OF SULFUR FROM RECYCLE GAS STREAMS IN CATALYTIC REFORMING

FIELD OF THE INVENTION

The present invention relates to the removal of sulfur from a process unit for catalytically reforming a naphtha feedstream boiling in the gasoline range. The sulfur is sulfur which is inherent in the feedstock, as well as sulfur resulting from catayst presulfiding. The removal is accomplished by use of a massive nickel trap in a process gas line.

BACKGROUND OF THE INVENTION

Catalytic reforming is a well established refinery process for improving the octane quality of naphthas or straight run gasolines. Reforming can be defined as the total effect of the molecular changes, or hydrocarbon reactions, produced by dehydrogenation of cyclohexanes, dehydroisomerization of alkylcyclopentanes, and dehydrocyclization of paraffins and olefins to yield aromatics; isomerization of n-paraffins; isomerization of alkylcyclopentanes to yield cyclohexanes; isomerization of substituted aromatics; and hydrocracking of paraffins which produces gas, and inevitably coke, the latter being deposited on the catalyst. In catalytic reforming, a multifunctional catalyst is usually employed which contains a metal hydrogenation-dehydrogenation (hydrogen transfer) component, or components, usually platinum, substantially atomically dispersed on the surface of a porous, inorganic oxide support, such as alumina. The support, which usually contains a halide, particularly chloride, provides the acid functionality needed for isomerization, cyclization, and dehydrocyclization reactions.

Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating of the reaction stream from one reactor to another. There are three major types of reforming: semiregenerative, cyclic, and continuous. Fixed-bed reactors are usually employed in semiregenerative and cyclic reforming, and moving-bed reactors in continuous reforming. In semiregenerative reforming, the entire reforming process unit is operated by gradually and progressively increasing the temperature to compensate for deactivation of the catalyst caused by coke deposition, until finally the entire unit is shutdown for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series. In continuous reforming, the reactors are moving-bed reactors, as opposed to fixed-bed reactors, with continuous addition and withdrawal of catalyst. The catalyst is regenerated in a separate regeneration vessel.

In reforming, sulfur compounds, even at a 1–2 ppm level contribute to a loss of catalyst activity and $C_5+$ liquid yield, particularly with the new sulfur-sensitive multimetallic catalysts. For example, a platinum-rhenium catalyst is so sensitive to sulfur poisoning that it is necessary to reduce sulfur to well below 0.1 wppm to avoid excessive loss of catalyst activity and $C_5+$ liquid yield.

Generally, all petroleum naphtha feeds contain sulfur. Consequently, most of the sulfur is usually removed from the feed by hydrofining with conventional hydrodesulfurization catalysts comprised of molybdenum with nickel or cobalt, or both, on a carrier such as alumina. The severity of the hydrofining can be increased so that essentially all of the sulfur is removed from the naphtha in the form of $H_2S$. However, small quantities of olefins are also produced. As a consequence, when the exit stream from the hydrofiner is cooled, sulfur can be reincorporated into the naphtha by the combination of $H_2S$ with the olefins to produce mercaptans. Hence, if a refiner is willing to pay the price, a hydrofining process can be employed at high severity to remove substantially all of the sulfur from a feed, but it is rather costly to maintain a product which consistently contains less than about 1–2 parts per million by weight of sulfur. Also, during hydrofiner upsets, the sulfur concentration in the hydrofined product can be considerably higher, e.g., as high as 50 ppm, or greater.

While hydrofining may remove most of the sulfur from the feedstock, sulfur still remains a problem in catalytic reforming because another source of sulfur results from catalyst presulfiding. It is generally necessary to passivate the active metal sites on fresh, or freshly regenerated catalysts prior to contacting with feed. This helps prevent excessive demethylation reactions, low liquid yields, and possible temperature runaways. Passivation is accomplished by first reducing the catalyst with hydrogen, followed by treating it with about 0.1 wt. % sulfur in the form of $H_2S$, di-teriary polysulfide (TNPS), or other suitable sulfur compounds, particularly the organic sulfur compounds. While most of this sulfur is gradually depleted from the catalyst during normal operation of the unit and removed during removal of make fuel gas, the remainder (up to about 30% or original) is recirculated. In cyclic reformers, this remaining recirculating sulfur has the effect of depressing activity in all of the reactors.

Various techniques have been used to remove sulfur, primarily from the feed. For example, one method for removing sulfur from feedstreams which has met with a limited amount of success is taught in U.S. Pat. No. 4,634,515, which is incorporated herein by reference. This patent teaches removal of sulfur from liquid phase feedstreams by use of a fixed bed of massive nickel catalyst, the nickel being supported on alumina. This method requires use of temperatures in the range of about 300° F. to 500° F. While such a method does in fact remove the sulfur inherent in the feedstock, it does not teach removal of sulfur resulting from presulfiding the catalyst. U.S. Pat. No. 4,519,829 is an improvement on this method, by incorporating, with the massive nickel, from 1 to 15 weight percent iron to suppress the production of PNAs.

Various techniques have also been proposed to remove sulfur from gas streams which could be employed on the recycle gas streams. For example, it has been proposed to remove sulfur by use of zinc alumina spinel, see U.S. Pat. Nos. 4,263,020 and 4,690,806. The drawback of using spinel compositions is that they have a relatively low capacity for sulfur, e.g. 1–2%, and thus, require their own regeneration facility. It has also been proposed to use zinc traps, such as a zinc oxide trap, see for example U.S. Pat. Nos. 4,717,552; 4,371,507; and 4,313,820. Zinc oxide traps tend to deteriorate rapidly in the presence of chloride and thus a chloride trap upstream of the zinc trap is required.

Other references teach the use of various high temperature traps, such as U.S. Pat. No. 4,187,282 which teaches the use of iron/copper/titanium oxide at a temperature from about 480° to 932° F; U.S. Pat. No. 4,273,748 which teaches the use of dual iron/nickel oxide beds operating at temperatures of 842° and 1300° F; and U.S. Pat. No. 4,140,752 which teaches the use of vanadium, nickel, and/or potassium on activated carbon.

While some of the above methods for removing sulfur have met with various degrees of commercial success, there is still a need in the art for the removal of sulfur which is both inherent in the feedstock as well as sulfur resulting from presulfiding the catalyst.

SUMMARY OF THE INVENTION

In accordance with the present invention, there is provided an improved process for reforming a gasoline boiling range hydrocarbonaceous feedstock in the presence of hydrogen and in a reforming process unit, said process unit comprised of a plurality of serially connected reactors, inclusive of a lead reactor and one or more downstream reactors, the last of which is a tail reactor, and wherein each of the reactors contains a supported noble metal-containing catalyst and wherein a hydrogen-containing gas is recycled from one or more of the downstream reactors to the lead reactor, the improvement which comprises passing the recycle gas through a sulfur trap prior to it entering the lead reactor, said sulfur trap containing a catalyst comprised of about 10 to about 70 wt. % nickel dispersed on a support.

In a preferred embodiment of the present invention, the gaseous stream passing through the trap also contains up to about 3.5 wt. % chloride.

In another preferred embodiment of the present invention, the process unit is a cyclic unit and at least about 50% of the nickel is in a reduced state and is comprised of metal crystallites having an average size greater than about 75 angstroms.

DETAILED DESCRIPTION OF THE INVENTION

Figure 1:
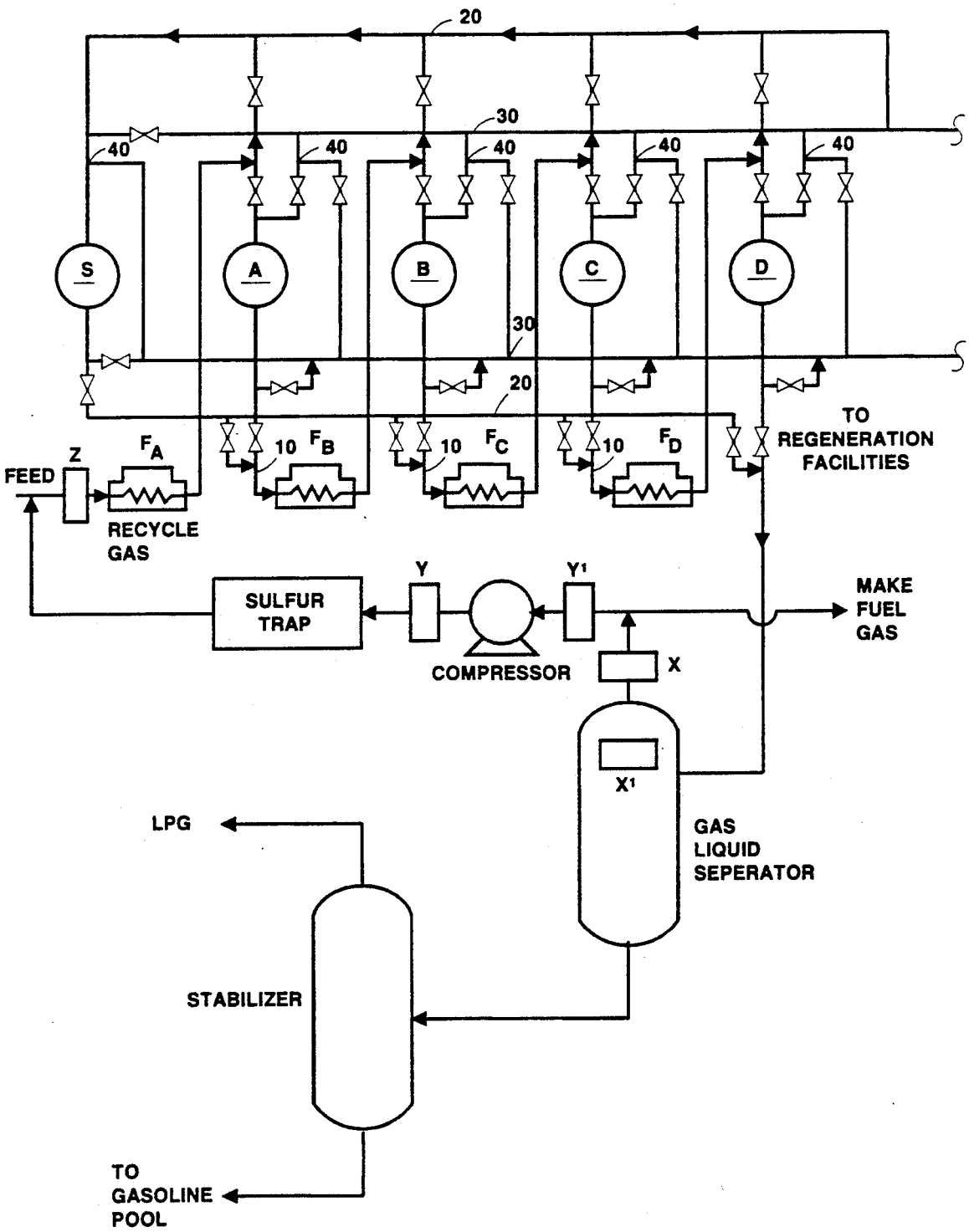
FIG. 1 is a simplified flow diagram of a typical cyclic reforming process unit, inclusive of multiple on-stream reactors, an alternate or swing reactor inclusive of manifolds and reactor by-passes for use with catalyst regeneration and reactivation equipment.

Feedstocks which are typically used for reforming in accordance with the process of the instant invention are any hydrocarbonaceous feedstock boiling in the gasoline range. Non-limiting examples of such feedstocks include the light hydrocarbon oils boiling from about 70° F. to about 500° F., preferably from about 180° F. to about 400° F. Such feedstocks include straight run naphtha, synthetically produced naphtha such as a coal or oil-shale derived naphtha, thermally or catalytically cracked naphtha, hydrocracked naphtha, or blends or fractions thereof.

Catalysts typically suitable for reforming, as practiced by the present invention, include both monofunctional and bifunctional multimetallic Pt-containing reforming catalysts. Preferred are the bifunctional reforming catalysts comprised of a hydrogenation-dehydrogenation function and an acid function. The acid function, which is important for isomerization ractions, is thought to be associated with a material of the porous, adsorptive, refractory oxide, preferably alumnia, which serves as the support, or carrier, for the metal component. The metal component is typically a Group VIII noble metal, such as platinum, which is generally attributed the hydrogenation-dehydrogenation function. The support material may also be a crystalline aluminosilicate, such as a zeolite. Non-limiting examples of zeolites which may be used herein include those having an effective pore diameter, particularly L-zeolite, zeolite, X, and zeolite Y. Preferably, the Group VIII noble metal is platinum. One or more promoter metals selected from metals of Groups IIIA, IVA, IB, VIB, and VIIB of the Periodic Table of the Elements may also be present. The promoter metal can be present in the form of an oxide, sulfide, or in the elemental state in an amount ranging from about 0.01 to about 5 wt. %, preferably from about 0.1 to 3 wt. %, and more preferably from about 0.2 to 3 wt. %, calculated on an elemental basis, and based on the total weight of the catalyst composition. It is also preferred that the catalyst compositions have a relatively high surface area, for example, about 100 to 250 $m^2/g$. The Periodic Table of the Elements referred to herein is published by Sergeant-Welch Scientific Company and having a copyright date of 1979 and available from them as Catalog Number S-18806.

Reforming catalysts also usually contain a halide component which contributes to the necessary acid functionality of the catalyst. It is preferred that this halide component be chloride in an amount ranging from about 0.1 to 3.5 wt. %, preferably from about 0.5 to 1.5 wt. %, calculated on an elemental basis on the final catalyst composition.

It is generally preferred that the platinum group metal be present on the catalyst in an amount ranging from about 0.01 to 5 wt. %, also calculated on an elemental metal basis on the final catalyst composition. More preferably the catalyst comprises from about 0.1 to about 2 wt. % platinum group metal, especially from about 0.1 to 2 wt. % platinum. Other platinum group metals suitable for use herein include palladium, iridium, rhodium, osmium, ruthenium, and mixtures thereof.

Referring to FIG. 1, there is described a reforming cyclic process unit comprised of a multi-reactor system, inclusive of on-stream reactors A, B, C, D, and a swing reactor S, and a manifold useful with a facility for periodic regeneration and reactivation of the catalyst of any given reactor. Swing reactor S is manifolded to reactors A, B, C, and D so that it can serve as a substitute reactor for purposes of regeneration and reactivation of the catalyst of a reactor taken off-stream. The several reactors of the series A, B, C, and D are arranged so that while one reactor is off-stream for regeneration and reactivation of the catalyst, it can be replaced by the swing reactor S. Provision is also made for regeneration and reactivation of the catalyst of the swing reactor.

The on-stream reactors A, B, C, and D are each provided with a separate furnace, or heater, $F_A$, $F_B$, $F_C$, and $F_D$ respectively, and all are connected in series via an arrangement of connecting process piping and valves, designated by the numeral 10, so that feed can be passed serially through $F_A$A, $F_B$B, $F_C$C, and $F_D$D, respectively; or generally similar grouping wherein any of Reactors A, B, C, and D respectively, can be substituted by swing Reactor S, as when the catalyst of any one of the former requires regeneration and reactivation. This is accomplished by "paralleling" the swing reactor with the reactor to be removed from the circuit for regeneration by opening the valves on each side of a given reactor which connect to the upper and lower lines of swing header 20, and then closing off the valves in line 10 on both sides of said reactor so that fluid enters and exits from said swing Reactor S. Regeneration facilities, shown in FIG. 2 hereof, are manifolded to each of the several Reactors A, B, C, D, and S through a parallel circuit of connecting piping and valves which form the upper and lower lines of regeneration header 30, and any one of the several reactors can be individually isolated from the other reactors of the unit and the catalyst thereof regenerated and reactivated.

The product from the fourth, or tail, reactor is flashed off in a gas-liquid separator with primarily hydrogen and methane, and sulfur-containing gases, such as hydrogen sulfide, going overhead. This stream is divided into fuel gas and recycle gas. It is preferred that the recycle gas first be recompressed, then passed through a sulfur trap, and returned to the reactor system where it is combined with fresh feed upstream of the lead reactor $F_A$. The separator bottoms are stabilized of LPG and blended into the gasoline pool.

Figure 2:
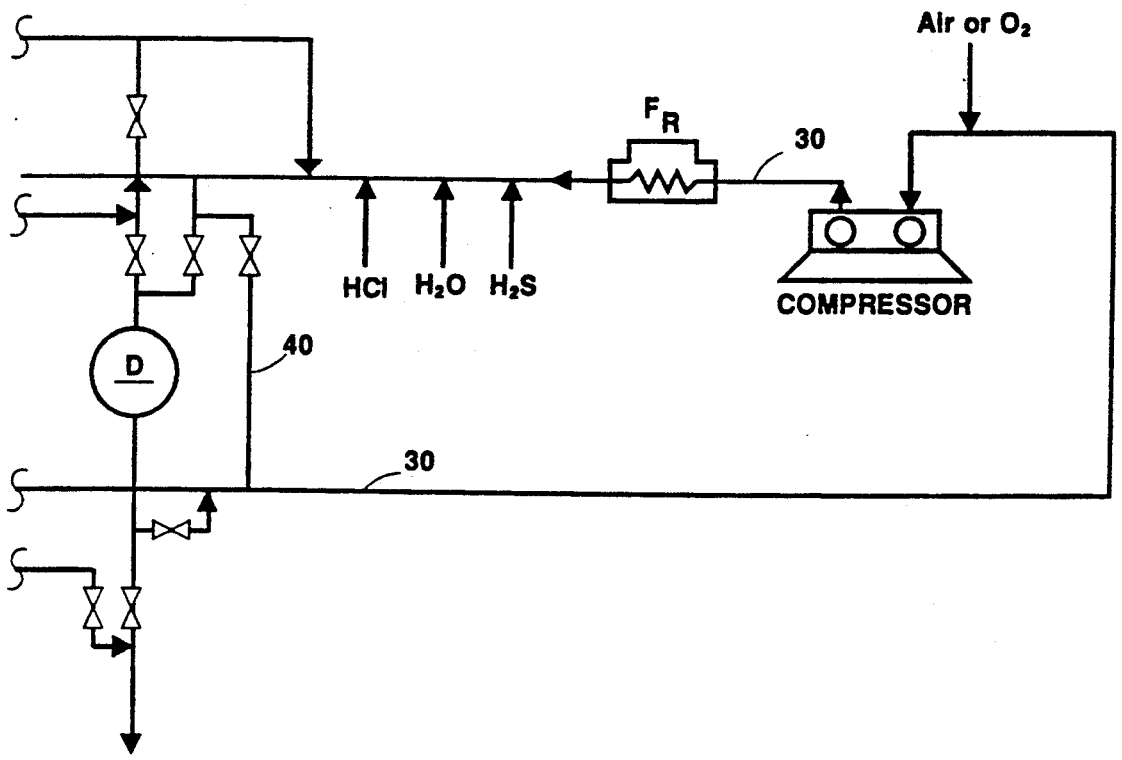
FIG. 2 is a simplified flow diagram of a typical catalyst regeneration and reactivation facility, and the manner in which the coked deactivated catalyst of a given reactor of a cyclic unit can be regenerated and reactivated, as practiced in accordance with the present invention.

FIG. 2 depicts the catalyst regeneration and reactivation circuit, of the illustrated process unit which is used for the regeneration and reactivation of the coked deactivated catalyst of a reactor, e.g., the catalyst of Reactor D, which has been taken off line and replaced by Swing Reactor S. The catalyst regeneration and reactivation circuit generally includes a compressor, regenerator furnace $F_R$, serially connected with the Reactor D which has been taken off line for regeneration and reactivation of the coked deactivated catalyst. The so formed circuit also includes location for injection of water, oxygen, hydrogen sulfide, and hydrochloric acid, as shown. A more detailed discussion of regeneration and reactivation of a reforming catalyst can be found in U.S. Pat. No. 4,769,128 which is incorporated herein by reference.

During regeneration of a coked deactivated catalyst, oxygen is injected upstream of the recycle gas compressor via regenerator furnace $F_R$ into Reactor D. In reactivation of the coke-depleted catalyst, oxygen, hydrogen sulfide, hydrochloric acid, and water if needed, are injected into Reactor D to redisperse the agglomerated catalytic metal, or metals, components of the catalyst. The hydrogen sulfide is added to passivate the catalyst before it is contacted with feed. The hydrogen sulfide, hydrochloric acid, and water are added downstream of the regenerator furnace $F_R$.

The sulfur contained in the separator overhead gas can be removed by use of a massive nickel trap placed in a product gas stream line. It can also be placed in the upper section of the seprator. For example, the sulfur trap can be placed: (X) in a section of gaseous product line after the gas-liquid separator but prior to it being divided into a recycle gas stream and a fuel gas stream; (Y) in the recycle gas line, upstream (Y') or downstream of the compresor (Y); or (Z) in the feed line after the recycle gas is mixed with the feedstock, but prior to introduction into the lead furnace. The sulfur trap may also be incorporated into the upper section (X') of the gas/liquid separator. In this way, the sulfur trap would de-entrain the liquid being carried overhead with the gas. The letters X, X', Y, Y', and Z refer to those used in FIG. 1 hereof.

The sulfur trap is packed with a bed of nickel adsorbent of large crystallite size in highly reduced form, supported on alumina. In general, the nickel concentration ranges from about 10 percent to about 70 percent, preferably above about 45 percent, more preferably from about 45 percent to about 55 percent, based on the total weight of the catalyst bed (dry basis). At least 50 percent, preferably at least 60 percent of the nickel is present in a reduced state, and the metal crystallites are greater than 75 Angstrom units, Å, average diameter, and preferably at least about 95 Å average diameter. In particular, the nickel component of the adsorbent ranges from about 45 percent to about 55 percent, preferably from about 48 percent to about 52 percent elemental, or metallic nickel, based on the total weight of the supported component (dry basis). The size of the nickel crystallites range above about 100 Å to about 300 Å, average diameter. A nickel adsorbent so characterized is far more effective for sulfur uptake than a supported nickel catalyst, or adsorbent of equivalent nickel content with smaller metal crystallites.

The nickel containing absorbent is effective even if the stream contains HCl which is often the case in reforming since chlorides are continuously being depleted from the catalysts and replaced by injection of a small amount of organic chloride with the naphtha feed.

The alumina component of the nickel-alumina adsorbent, or catalyst, is preferably gamma alumina, and contains a minimum of contaminants, generally less than about 1 percent, based on the total weight of the catalyst (dry basis). In particular, the alumina has a low silica content. That is, the silica content should not exceed about 0.7 percent, and will preferably range from about 0 and 0.5 percent, based on the weight of the alumina (dry basis).

Having thus described the present invention and a preferred and most referred embodiment thereof, it is believed that the same will become even more apparent by reference to the following examples. It will be appreciated, however, that the examples are presented for illustrative purposes and should not be construed as limiting the invention.

EXAMPLE 1

This example was run to determine if massive nickel will absorb an appreciable amount of $H_2S$ at temperatures as low as about 180° F.

A sulfur adsorption test by TGA (Thermo Gravimetric Analysis) was devised to compare the performance of massive nickel in the sulfur trap at a total pressure of 1 atmosphere and 500° F. and 180° F. respectively. Approximately 100 mg of fresh catalyst were charged and heated to 900° F. in argon until no further weight loss was observed. Then it was cooled to 500° F. in flowing argon. After temperature equilibration, a stream consisting of 2 vol. % $H_2S$/98 vol. % Ar was introduced and weight gain due to sulfur adsorption measured with time until lineout at 500° F. The same experiment was performed on fresh catalyst for a temperature of 180° F.

The capacity was determined by measuring the weight gain ($H_2S$ uptake), of the massive nickel and is shown in Table 1 below.

TABLE 1

| Temperature, °F. | % $H_2S$ Uptake |
|---|---|
| 500 | 26 |
| 180 | 22 |

EXAMPLE 2

This example was run at conditions closer to process conditions, and at a temperature of 180° F., a temperature representative of the temperature of a recycle gas stream in a cyclic catalytic reforming process unit.

A sample of massive nickel was saturated with HCl wherein the resulting massive nickel sample was found to contain about 20 wt. % Cl. The sample was placed in a microbalance and subjected to 0.1 vol. % $H_2S$ in hydrogen for 30 hours at a temperature of 180° F. $H_2S$ uptake was found to be about 10%.

This example also demonstrates that sulfur can removed by use of a massive nickel trap in the presence of chloride.

EXAMPLE 3

15 grams of massive nickel were loaded into a packed bed and contacted with a gas stream containing 2 vol. % $H_2S$ in hydrogen at 180° F. at a total pressure of 1 atmosphere and a flow rate of 27 liters (STP) per hour. $H_2S$ breakthrough occurred after uptake of 9 wt. % $H_2S$.

What is claimed is:

1. In a process for catalytically reforming a hydrocarbonaceous feedstock boiling in the gasoline range, wherein the reforming is conducted in the presence of hydrogen in a reforming process unit under reforming conditions, said process unit comprised of a plurality of serially connected reactors, each of said reactors containing a reforming catalyst, and which process unit also includes a regeneration circuit for regenerating the catalyst after it becomes coked, said regeneration comprising treatment with a sulfur containing gas, and which process unit also includes a gas/liquid separator wherein a portion of the gas is recycled and the remaining portion is collected as make-gas, the improvement which comprises using a sulfur trap, containing a catalyst comprised of about 10 to about 70 wt. % nickel dispersed on a support, between the gas/liquid separator and the first reactor.

2. The process of claim 1 wherein the sulfur trap is comprised of about 45 to about 70 wt. % nickel.

3. The process of claim 2 wherein at least 50% of the nickel is in a reduced state and is comprised of metal crystallites having an average size greater than about 75 Angstroms.

4. The process of claim 3 wherein up to about 3.5 wt. % chloride is present.

5. The process of claim 1 wherein the sulfur trap is in the recycle stream line.

6. The process of claim 1 wherein the sulfurtrap is between the gas/liquid separator and the, but before the recycle gas line.

7. The process of claim 1 wherein the sulfur trap is located in the upper section of the gas/liquid separator.

8. The process of claim 1 wherein the process unit is selected from the group consisting of a semi-regen unit, a semi-cyclic unit, and a cyclic unit.

9. The process of claim 4 wherein the process unit is selected from the group consisting of a semi-regen unit, a semi-cyclic unit, and a cyclic unit.

10. The process of claim 8 wherein the process unit is a cyclic unit.

11. The process of claim 9 wherein the process unit is a cyclic unit.

12. The process of claim 1 wherein the process unit is a cyclic unit.

13. The process of claim 1 wherein the sulfur trap is located just prior to the first reactor so that a mixture of feedstock and recycle gas is passed through it.

* * * * *